US009373431B2

(12) United States Patent
Ikeda et al.

(10) Patent No.: US 9,373,431 B2
(45) Date of Patent: Jun. 21, 2016

(54) NTC THERMISTOR ELEMENT AND METHOD AND METHOD FOR PRODUCING THE SAME

(71) Applicant: MURATA MANUFACTURING CO., LTD., Nagaokakyo-shi, Kyoto-Fu (JP)

(72) Inventors: Hiroshi Ikeda, Nagaokakyo (JP); Tadamasa Miura, Nagaokakyo (JP)

(73) Assignee: MURATA MANUFACTURING CO., LTD., Nagaokakyo-Shi, Kyoto-Fu (JP)

( * ) Notice: Subject to any disclaimer, the term of this patent is extended or adjusted under 35 U.S.C. 154(b) by 95 days.

(21) Appl. No.: 14/519,210

(22) Filed: Oct. 21, 2014

(65) Prior Publication Data

US 2015/0070127 A1 Mar. 12, 2015

Related U.S. Application Data

(63) Continuation of application No. PCT/JP2013/060602, filed on Apr. 8, 2013.

(30) Foreign Application Priority Data

May 28, 2012 (JP) ..... 2012-120731

(51) Int. Cl.

| | |
|---|---|
| ***H01C 7/00*** | (2006.01) |
| ***H01C 1/14*** | (2006.01) |
| ***H01C 7/04*** | (2006.01) |
| ***H01C 17/06*** | (2006.01) |

(52) U.S. Cl.

CPC ..... *H01C 1/1413* (2013.01); *H01C 7/04* (2013.01); *H01C 7/042* (2013.01); *H01C 17/06* (2013.01); *Y10T 29/49085* (2015.01)

(58) Field of Classification Search

CPC .... H01C 1/1413; H01C 7/042; H01C 17/283; H01C 17/286; H01C 7/146

USPC ..... 338/22 R

See application file for complete search history.

(56) References Cited

U.S. PATENT DOCUMENTS

| | | | | |
|---|---|---|---|---|
| 7,948,354 | B2 * | 5/2011 | Miura | H01C 7/18 338/22 R |
| 8,598,975 | B2 * | 12/2013 | Miura | G01K 7/22 338/13 |
| 8,669,841 | B2 * | 3/2014 | Miura | H01C 7/043 338/22 R |
| 2008/0048821 | A1 | 2/2008 | Miura et al. | |
| 2009/0167482 | A1 * | 7/2009 | Miura | C04B 35/01 338/22 SD |
| 2009/0179732 | A1 | 7/2009 | Koto | |

FOREIGN PATENT DOCUMENTS

| | | | |
|---|---|---|---|
| WO | WO-2006/085507 | A1 | 8/2006 |
| WO | WO-2008/041481 | A1 | 4/2008 |

OTHER PUBLICATIONS

PCT/JP2013/060602 Written Opinion dated May 17, 2013.

* cited by examiner

*Primary Examiner* — Kyung Lee

(74) *Attorney, Agent, or Firm* — Arent Fox LLP

(57) ABSTRACT

A NTC thermistor element that includes a substrate composed of a ceramic material containing Mn, Ni, Fe and Ti; and a pair of external electrodes on the substrate. When the molar amount of Mn in the substrate is a [mol %] and the molar amount of Ni in the substrate is b [mol %], a and b satisfy a+b=100, 44.90≤a≤65.27 and 34.73≤b≤55.10. When the molar amount of Fe is c [mol %] and the molar amount of Ti is d [mol %], c and d satisfy 24.22≤c≤39.57 and 5.04≤d≤10.18 based on a+b=100.

16 Claims, 1 Drawing Sheet

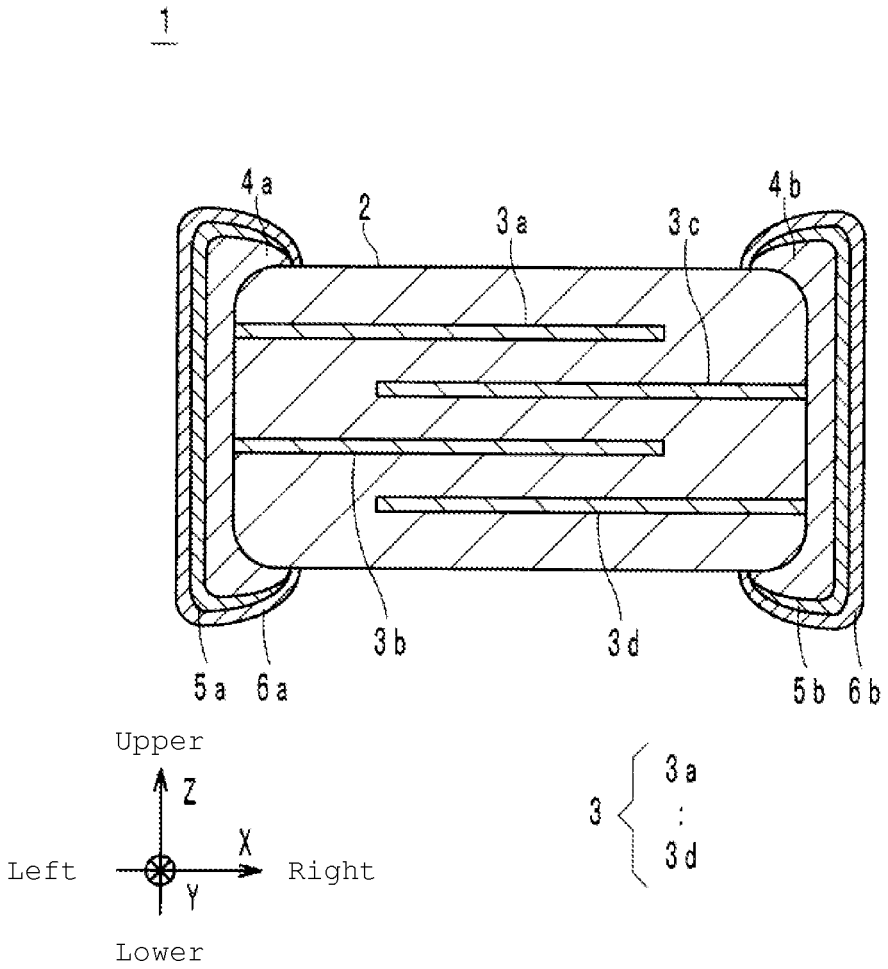
1
4a
2
3a
3c
4b
3b
3d
5a
6a
5b
6b
Upper
Z
X
Left
Right
Y
Lower
3
3a
:
3d

NTC THERMISTOR ELEMENT AND METHOD AND METHOD FOR PRODUCING THE SAME

CROSS REFERENCE TO RELATED APPLICATIONS

The present application is a continuation of International application No. PCT/JP2013/060602, filed Apr. 8, 2013, which claims priority to Japanese Patent Application No. 2012-120731, filed May 28, 2012, the entire contents of each of which are incorporated herein by reference.

FIELD OF THE INVENTION

The present invention relates to a NTC thermistor element having a negative temperature characteristic, and a method for producing the same.

BACKGROUND OF THE INVENTION

Examples of the conventional NTC thermistor element include one described in Patent Document 1 below. The NTC thermistor element generally includes a ceramic body, and an external electrode formed on the ceramic body. The ceramic body is composed of a semiconductor ceramic material containing Mn, Ni and Ti, and satisfies the following requirements (1) and (2). The semiconductor ceramic material may contain Fe.

(1) When the molar amount of Mn contained in the semiconductor ceramic material is a and the molar amount of Ni contained in the semiconductor ceramic material is b, a and b satisfy $55/45 \leq a/b \leq 90/10$.

(2) When the total molar amount of Mn and Ni in the semiconductor ceramic material is 100 parts by mole, Ti is contained in an amount of 0.5 parts by mole to 25 parts by mole (inclusive).

Patent Document 1: International Publication No. WO 2006/085507

SUMMARY OF THE INVENTION

In recent years, NTC thermistor elements have been used not only in household electric appliances and consumer appliances but also in on-vehicle applications. Usually, on-vehicle devices are subjected to more strict reliability tests in terms of heat resistance etc. as compared to consumer appliances.

However, the NTC thermistor element in Patent Document 1 has a problem in terms of heat resistance because the resistance value and the B constant significantly change when a heat resistance test is conducted using a test method in which the thermistor element is left standing at 150° C. for 1000 hours.

Accordingly, an object of the present invention is to provide a NTC thermistor element excellent in heat resistance.

For achieving the above-described object, a first aspect of the present invention is a NTC thermistor element including: a substrate composed of a ceramic material containing Mn, Ni, Fe and Ti; and a pair of external electrodes formed on the substrate.

When the molar amount of Mn is a [mol %] and the molar amount of Ni is b [mol %], a and b satisfy $a+b=100$, $44.90 \leq a \leq 65.27$ and $34.73 \leq b \leq 55.10$. When the molar amount of Fe is c [mol %] and the molar amount of Ti is d [mol %], c and d satisfy $24.22 \leq c \leq 39.57$ and $5.04 \leq d \leq 10.18$ based on $a+b=100$.

A second aspect of the present invention is a method for producing a NTC thermistor element, the method including: a first step of generating a substrate from a ceramic raw material composed of a manganese compound, a nickel compound, an iron compound and a titanium compound; and a second step of forming a pair of external electrodes on the substrate generated in the first step.

When the molar amount of Mn in the ceramic raw material is a' [mol %] and the molar amount of Ni in the ceramic raw material is b' [mol %], a' and b' satisfy $a'+b'=100$, $45.00 \leq a' \leq 65.42$ and $34.58 \leq b' \leq 55.00$.

When the molar amount of Fe in the ceramic raw material is c' [mol %] and the molar amount of Ti in the ceramic raw material is d' [mol %], c' and d' satisfy $25.48 \leq c' \leq 40.00$ and $5.00 \leq d' \leq 10.10$ based on $a'+b'=100$.

According to the first and second aspects, a NTC thermistor element excellent in heat resistance can be provided.

BRIEF EXPLANATION OF THE DRAWING

The FIGURE is a longitudinal sectional view showing a configuration of a NTC thermistor element according to one embodiment of the present invention.

DETAILED DESCRIPTION OF THE INVENTION

Embodiment

Hereinafter, a NTC thermistor element 1 according to one embodiment of the present invention will be described in detail with reference to the FIGURE.

First, the X axis, Y axis and Z axis shown in the FIGURE will be defined. The X axis, Y axis and z axis show a horizontal direction, a longitudinal direction and a vertical direction, respectively, of the NTC thermistor element 1.

(Configuration of NTC Thermistor Element)

The FIGURE illustrates a surface mounting-type NTC thermistor element 1. The NTC thermistor element 1 includes a substrate 2, a plurality of internal electrodes 3 (illustrated are internal electrodes 3*a* to 3*d*), a pair of external electrodes 4*a* and 4*b*, first plated films 5*a* and 5*b* and second plated films 6*a* and 6*b*.

In this embodiment, the substrate 2 has, for example, an approximately parallelepiped shape that is long in the horizontal direction. The substrate 2 is composed of a ceramic material having a negative temperature characteristic. More specifically, the substrate 2 contains Mn (manganese) and Ni (nickel) as main components (basic compositions), and further contains Fe (iron) and Ti (titanium) as additives.

The internal electrodes 3*a* to 3*d* are composed of a noble metal alloy (e.g. silver palladium alloy) that is hardly oxidized in the air, and are formed in the substrate 2. In the example in the FIGURE, the internal electrodes 3*a* and 3*b* form a left-side comb-like electrode, and the internal electrodes 3*c* and 3*d* form a right-side comb-like electrode. Specifically, the internal electrodes 3*a* and 3*b* each extend from the left end to the right end of the substrate 2, and the internal electrodes 3*c* and 3*d* each extend from the right end to the left end of the substrate 2. The internal electrodes 3*a* and 3*b* (left-side comb-like electrode) and the internal electrodes 3*c* and 3*d* (right-side comb-like electrode) engage with each other with a predetermined distance held in the vertical direction.

The external electrodes 4*a* and 4*b* are composed of a noble metal (e.g. silver). The external electrode 4*a* is formed on the left end surface of the substrate 2 so as to be electrically conducted to the internal electrodes 3*a* and 3*b*, and the external electrode 4*b* is formed on the right end surface of the substrate 2 so as to be electrically conducted to the internal electrodes 3*c* and 3*d*.

The first plated films 5*a* and 5*b* are composed of, for example, Ni, and are formed on the external electrodes 4*a* and 4*b*. The second plated films 6*a* and 6*b* are composed of, for example, Sn (tin), and are formed on the first plated films 5*a* and 5*b*.

(One Example of Method for Producing NTC Thermistor Element)

A process for producing the NTC thermistor element 1 generally includes a first step of preparing the substrate 2 including the internal electrode 3 therein, and a second step of forming external electrodes 4*a* and 4*b* and the like on the substrate 2 prepared in the first step.

More specifically, the first step includes the following detailed steps (A) to (H).

(A) A predetermined amount of each of $Mn_3O_4$, NiO, $Fe_2O_3$, and $TiO_2$ that are ceramic raw materials is weighed.

(B) The ceramic raw materials weighed in the step (A) are introduced into a ball mill including a grinding medium such as zirconia, and sufficiently wet-ground.

(C) The ceramic raw materials ground in the step (B) are calcined at 760° C. for 2 hours, so that a ceramic powder is prepared.

(D) A predetermined amount of an organic binder is added to the ceramic powder prepared in the step (C). The ceramic powder and the organic binder are wet-mixed and formed into a slurry.

(E) The slurry obtained in the step (D) is molded by a doctor blade method, for example, to obtain a ceramic green sheet.

(F) On the ceramic green sheet obtained in the step (E), a pattern of the internal electrode 3 is screen-printed using a paste for an internal electrode which has a silver palladium alloy as a main component.

(G) A plurality of ceramic green sheets each having the internal electrode 3 printed thereon in the step (F) are laminated. A ceramic green sheet which is not printed with the internal electrode 3 is press-bonded to each of upper and lower surfaces of the thus obtained laminate.

(H) The laminate obtained in the step (G) is cut to a predetermined size, and then stored in a box made of zirconia. Thereafter, the cut laminate is subjected to a binder removing treatment at 350° C. for 2 hours, and then fired at a predetermined temperature (e.g. 1100° C. to 1175° C.). Consequently, the substrate 2 including the internal electrode 3 therein is obtained.

Next, the second step is carried out. The second step includes the following detailed steps (I) and (J).

(I) A paste for an external electrode which has silver as a main component is applied to and baked on each of left and right end surfaces of the substrate 2 obtained in the step (H). Consequently, external electrodes 4*a* and 4*b* are formed.

(J) First plated films 5*a* and 5*b* of Ni are formed by electroplating on the external electrode 4*a* and 4*b* formed in the step (I). Second plated films 6*a* and 6*b* are formed on the first plated films 5*a* and 5*b* by electroplating.

The NTC thermistor element 1 is completed through the above steps (A) to (J).

(Detailed Composition of Substrate)

In this embodiment, the contents of Mn, Ni, Fe and Ti in the substrate 2 of the completed product of the NTC thermistor element 1 fall within the value range described in (1) and (2) below in view of improving heat resistance of the thermistor element 1.

(1) When the molar amounts of Mn and Ni in the substrate 2 are a [mol %] and b [mol %], respectively (where a+b=100 [mol %]), a and b satisfy $64.43 \le a \le 65.27$ and $34.73 \le b \le 35.57$.

(2) When the molar amounts of Fe and Ti in the substrate 2 are c [mol %] and d [mol %], respectively, c and d satisfy $24.22 \le c \le 25.25$ and $9.28 \le d \le 10.18$ based on a+b=100.

The inventors of the present application prepared 18 kinds of NTC thermistor elements (Lot Nos. 1 to 18) using ceramic raw materials having 18 combinations of contents of Mn, Ni, Fe and Ti as shown in Table 1. In Table 1, Lot Nos. 1 to 17 correspond to content ratios of Mn and the like in the raw material of the NTC thermistor element 1 according to this embodiment. Lot No. 18 corresponds to content ratios of Mn and the like in the raw material of a conventional NTC thermistor element.

TABLE 1

| Blending Ratio in Ceramic Raw Material | | | | | |
|---|---|---|---|---|---|
| | | Mn + Ni = 100 mol % | | Ratio based on Mn + Ni = 100 [mol %] | Ratio based on Mn + Ni = 100 [mol %] |
| | Lot Nos. | Mn a' mol % | Ni b' mol % | Fe c' mol % | Ti d' mol % |
| Present invention | 1 | 65.00 | 35.00 | 25.00 | 9.65 |
| | 2 | 64.58 | 35.42 | 25.00 | 9.65 |
| | 3 | 65.42 | 34.58 | 25.00 | 9.65 |
| | 4 | 65.27 | 34.73 | 25.52 | 9.69 |
| | 5 | 64.73 | 35.27 | 24.48 | 9.61 |
| | 6 | 64.85 | 35.15 | 25.52 | 9.69 |
| | 7 | 65.15 | 34.85 | 24.48 | 9.61 |
| | 8 | 64.83 | 35.17 | 24.49 | 9.61 |
| | 9 | 65.35 | 34.65 | 24.88 | 9.64 |
| | 10 | 64.65 | 35.35 | 25.13 | 9.66 |
| | 11 | 65.17 | 34.83 | 25.52 | 9.66 |
| | 12 | 65.00 | 35.00 | 25.00 | 9.20 |
| | 13 | 65.00 | 35.00 | 25.00 | 9.35 |
| | 14 | 65.00 | 35.00 | 25.00 | 9.50 |
| | 15 | 65.00 | 35.00 | 25.00 | 9.80 |
| | 16 | 65.00 | 35.00 | 25.00 | 9.95 |
| | 17 | 65.00 | 35.00 | 25.00 | 10.10 |
| Prior art | 18 | 70.00 | 30.00 | 2.00 | 5.60 |

In Table 1, the molar amounts of Mn and Ni in the ceramic raw material are a' [mol %] and b' [mol %], respectively. The molar amounts of Fe and Ti in the raw material are c' [mol %] and d' [mol %], respectively. It is to be noted that a' and b' satisfy a'+b'=100 [mol %]. c' and d' each represent a molar amount based on a'+b'=100.

In the case of Lot No. 1, a' is 65.00 [mol %], b' is 35.00 [mol %], c' is 25.00 [mol %] and d' is 9.65 [mol %]. For other Lot Nos. 2 to 18, a', b', c' and d' are described in the same manner as in Lot No. 1.

Further, the inventors of the present application analyzed content ratios of Mn, Ni, Fe and Ti in the substrate 2 of each thermistor element 1 by a WDX (wavelength dispersive X-ray spectrometer). Further, the inventors of the present application measured direct-current resistance values R25 and R50 in thermostat liquid phases at 25° C. and 50° C. for each thermistor element 1. A B constant between 25° C. and 50° C. (B25/50) was calculated in accordance with the following equation (1).

$$B25/50(K)=\log(R25/R50)/(1/(273.15+25)-1/(273.15+50)) \quad (1)$$

Reliability tests A and B were conducted for the NTC thermistor element 1 of each Lot No. The condition of the reliability test A includes leaving the thermistor element standing at 125° C. for 1000 hours, and the condition of the reliability test B includes leaving the thermistor element standing at 150° C. for 1000 hours. The inventors of the present application calculated a resistance change rate ΔR and a B constant change rate ΔB25/50 after each of the reliability tests A and B. ΔR is calculated from the following equation (2), and ΔB25/50 is calculated from the following equation (3).

$$\Delta R\ (\%)=(R25(1000\ \text{hr})-R25(0\ \text{hr}))/R25(0\ \text{hr})\times 100 \quad (2)$$

$$\Delta B\ (\%)=(B25/50(1000\ \text{hr})-B25/50(0\ \text{hr}))/B25/50(0\ \text{hr})\times 100 \quad (3)$$

In the equation (2), R25 (1000 hr) is a direct-current resistance value obtained by performing measurement in a thermostat liquid phase at 25° C. after leaving the thermistor element standing at 125° C. or 150° C. for 1000 hours. R25 (0 hr) is a direct-current resistance value obtained by performing measurement in a thermostat liquid phase at 25° C. before conducting reliability tests A and B.

In the equation (3), B25/50 (1000 hr) is a B constant between 25° C. and 50° C., which is calculated after leaving the thermistor element standing at 125° C. or 150° C. for 1000 hours. B25/50 (0 hr) is a B constant between 25° C. and 50° C., which is calculated before conducting reliability tests A and B.

Analysis/measurement results and calculated values from the above tests are shown in Table 2.

respectively. It is to be noted that a and b satisfy a+b=100 [mol %]. c and d each represent a molar amount based on a+b=100.

In Table 2, values of a to d, an electric resistivity ρ25 corresponding to the direct-current resistance value R25, B25/50, ΔR and ΔB25/50 in the reliability test A and ΔR and ΔB25/50 in the reliability test B are described for each Lot No.

For example, the NTC thermistor element of Lot No. 1 is made using a ceramic raw material of the same Lot No. shown in Table 1. In the case of Lot No. 1, a is 64.85 [mol %], b is 35.15 [mol %], c is 24.73 [mol %] and d is 9.73 [mol %]. ρ25 is 52.0 [kΩcm], and B25/50 is 4086 [K]. ΔR and ΔB25/50 in the reliability test A are 0.04% and 0.01, respectively. ΔR and ΔB25/50 in the reliability test B are 0.34% and 0.04, respectively.

For other Lot Nos. 2 to 18, each value is described in Table 2 in the same manner as in Lot No. 1. In Table 2, Lot Nos. 1 to 17 correspond to content ratios of Mn and the like in the NTC thermistor element 1 according to this embodiment. Lot No. 18 corresponds to content ratios of Mn and the like in a conventional NTC thermistor element.

As is apparent from Tables 1 and 2, Lot Nos. 1 to 17 have electrical characteristics (ρ25 and B25/50) sufficiently practicable as a NTC thermistor element similarly to Lot No. 18. Moreover, for Lot Nos. 1 to 17, ΔR is 0.39% or less, and

TABLE 2

Content Ratio in Completed Product of Thermistor Element (Embodiment)

| | | Mn + Ni = 100 mol % | | Ratio based on Mn + Ni =100 [mol %] | Ratio based on Mn + Ni = 100 [mol %] | Electrical characteristic evaluation results | | Reliability test A (left standing at 125° C. for 1000 hours) | | Reliability test B (left standing at 150° C. for 1000 hours) | |
|---|---|---|---|---|---|---|---|---|---|---|---|
| | Lot Nos. | Mn a mol % | Ni b mol % | Fe c mol % | Ti d mol % | ρ25 kΩ cm | B25/50 K | ΔR % | Δ B25/50 % | ΔR % | Δ B25/50 % |
| Present invention | 1 | 64.85 | 35.15 | 24.73 | 9.73 | 52.0 | 4086 | 0.04 | 0.01 | 0.34 | 0.04 |
| | 2 | 64.43 | 35.57 | 24.73 | 9.73 | 49.3 | 4065 | 0.06 | 0.02 | 0.39 | 0.05 |
| | 3 | 65.27 | 34.73 | 24.73 | 9.73 | 55.5 | 4112 | 0.04 | 0.01 | 0.39 | 0.05 |
| | 4 | 65.12 | 34.88 | 25.25 | 9.77 | 61.3 | 4117 | 0.08 | 0.02 | 0.38 | 0.04 |
| | 5 | 64.58 | 35.42 | 24.22 | 9.69 | 44.4 | 4054 | 0.05 | 0.02 | 0.38 | 0.04 |
| | 6 | 64.70 | 35.30 | 25.25 | 9.77 | 53.6 | 4092 | 0.05 | 0.02 | 0.37 | 0.04 |
| | 7 | 64.99 | 35.00 | 24.22 | 9.69 | 51.5 | 4082 | 0.06 | 0.02 | 0.38 | 0.04 |
| | 8 | 64.68 | 35.32 | 24.22 | 9.69 | 44.3 | 4061 | 0.08 | 0.03 | 0.38 | 0.04 |
| | 9 | 65.20 | 34.80 | 24.61 | 9.72 | 55.9 | 4106 | 0.08 | 0.03 | 0.36 | 0.04 |
| | 10 | 64.50 | 35.50 | 24.85 | 9.74 | 53.9 | 4076 | 0.09 | 0.03 | 0.36 | 0.04 |
| | 11 | 65.02 | 34.98 | 25.24 | 9.77 | 62.6 | 4111 | 0.04 | 0.01 | 0.38 | 0.04 |
| | 12 | 64.85 | 35.15 | 24.73 | 9.28 | 47.5 | 4038 | 0.10 | 0.03 | 0.35 | 0.04 |
| | 13 | 64.85 | 35.15 | 24.73 | 9.43 | 48.1 | 4050 | 0.05 | 0.02 | 0.31 | 0.04 |
| | 14 | 64.85 | 35.15 | 24.73 | 9.58 | 50.8 | 4065 | 0.06 | 0.02 | 0.32 | 0.04 |
| | 15 | 64.85 | 35.15 | 24.73 | 9.88 | 61.7 | 4093 | 0.07 | 0.02 | 0.34 | 0.04 |
| | 16 | 64.85 | 35.15 | 24.73 | 10.03 | 62.6 | 4109 | 0.08 | 0.03 | 0.34 | 0.04 |
| | 17 | 64.85 | 35.15 | 24.73 | 10.18 | 69.1 | 4124 | 0.09 | 0.03 | 0.33 | 0.04 |
| Prior art | 18 | — | — | — | — | 9.4 | 4053 | 0.40 | 0.09 | 0.65 | 0.12 |

In Table 2, the molar amounts of Mn and Ni in the completed product of the NTC thermistor element are a [mol %] and b [mol %], respectively. The molar amounts of Fe and Ti in the completed product are c [mol %] and d [mol %], ΔB25/50 is 0.05% or less after the reliability test B is conducted. These values are considerably superior to the values for Lot No. 18, and it is apparent that the thermistor element 1 has an extremely small change in electrical characteristics (resistance value and B constant) even when left standing under a high-temperature environment of 150° C. for 1000 hours.

As described above, when the contents of Mn, Ni, Fe and Ti in the substrate 2 are made to fall within the value range described in (1) and (2), heat resistance of the NTC thermistor element 1 can be improved.

From a different point of view, when the NTC thermistor element 1 is prepared while the contents of Mn, Ni, Fe and Ti in the ceramic raw material are made to fall within the value range described in (3) and (4), heat resistance of the NTC thermistor element 1 can be improved.

(3) The molar amounts of Mn and Ni in the ceramic raw material are a' [mol %] and b' [mol %], respectively, wherein a' and b' satisfy $64.58 \leq a' \leq 65.42$ and $34.58 \leq b' \leq 35.42$.

(4) The molar amounts of Fe and Ti in the ceramic raw material are c' [mol %] and d' [mol %], respectively, wherein c' and d' satisfy $24.48 \leq c' \leq 25.52$ and $9.20 \leq d' \leq 10.10$.

(Note)

In the above embodiment, a surface mounting-type NTC thermistor element is described. However, the method for mounting a NTC thermistor element on a print board is not limited to a surface mounting type, and may be a BGA (ball grid array) type.

In the above embodiment, the internal electrodes 3*a* to 3*d* are composed of a noble metal alloy, and the external electrodes 4*a* and 4*b* are composed of a noble metal. However, the present invention is not limited thereto, and the internal electrodes 3*a* to 3*d* may be composed of a noble metal, with the external electrodes 4*a* and 4*b* being composed of a noble metal alloy.

In the above embodiment, the first plated films 5*a* and 5*b* are Ni-plated films and the second plated films 6*a* and 6*b* are Sn-plated films in consideration of compatibility with the external electrodes 4*a* and 4*b* composed of silver. However, the present invention is not limited thereto, materials of the first plated films 5*a* and 5*b* and the second plated films 6*a* and 6*b* are appropriately selected according to the material of the external electrode 4*a* and 4*b*.

In the above embodiment, an oxide such as $Mn_3O_4$ is used as a ceramic raw material. However, the present invention is not limited thereto, and a carbonate, a hydroxide or the like of Mn etc. may be used. The same applies for Ni, Fe and Ti. That is, various compounds of Mn, Ni, Fe and Ti can be used as ceramic raw materials.

In the above embodiment, the substrate 2 is formed as a laminated structure by a doctor blade method in one example of the production method. However, the present invention is not limited thereto. When the internal electrode 3 is not provided, and only the external electrodes 4*a* and 4*b* are formed on left and right end surfaces of the substrate 2, the substrate 2 may be formed by dry molding.

The items described in the section of "Note" also hold true for a NTC thermistor element according to the following modification.

(Modification)

A NTC thermistor element according to a modification of the above embodiment will now be described. When compared with the NTC thermistor element according to the foregoing embodiment, the NTC thermistor element according to the modification is not different in basic configuration, and is different only in composition of the substrate as shown in Table 3 below. Therefore, in descriptions of this modification, the FIGURE is adopted, and in the modification, configurations equivalent to those in the embodiment are given the same symbols, and explanations thereof are omitted.

(Detailed Composition of Substrate)

In this modification, the molar amounts of Mn, Ni, Fe and Ti in the raw material of the NTC thermistor element 1 fall within the value range described in (5) and (6) below in view of improving heat resistance.

(5) The molar amounts of Mn and Ni in the ceramic raw material are a' [mol %] and b' [mol %], respectively (where a'+b'=100 [mol %]), wherein a' and b' satisfy $45.00 \leq a' \leq 65.00$ and $35.00 \leq b' \leq 55.00$.

(6) The molar amounts of Fe and Ti in the ceramic raw material are c' [mol %] and d' [mol %], respectively (where c' and d' each represent a molar amount based on a'+b'=100), wherein c' and d' satisfy $25.00 \leq c' \leq 40.00$ and $5.00 \leq d' \leq 9.65$.

In this modification, the contents of Mn, Ni, Fe and Ti in the substrate 2 of the completed product of the NTC thermistor element 1 using the above-mentioned raw material fall within the value range described in (7) and (8) below in view of improving heat resistance.

(7) When the molar amounts of Mn and Ni in the substrate 2 are a [mol %] and b [mol %], respectively (where a+b=100 [mol %]), a and b satisfy $44.90 \leq a \leq 64.85$ and $35.15 \leq b \leq 55.10$.

(8) When the molar amounts of Fe and Ti in the substrate 2 are c [mol %] and d [mol %], respectively, c and d satisfy $24.73 \leq c \leq 39.57$ and $5.04 \leq d \leq 9.73$ based on a+b=100.

For examining heat resistance of completed products of NTC thermistor elements produced using the above-described raw materials, 13 kinds of NTC thermistor elements (Lot Nos. 19 to 31) having compositions described in Table 4 were prepared using raw materials described in Table 3. Tables 3 and 4 are referred to in the same manner as in the case of Tables 1 and 2.

TABLE 3

Blending Ratio in Ceramic Raw Material (Modification)

| | | Mn + Ni = 100 mol % | | Ratio based on Mn + Ni = 100 [mol %] | Ratio based on Mn + Ni = 100 [mol %] |
|---|---|---|---|---|---|
| | Lot Nos. | Mn a' mol % | Ni b' mol % | Fe c' mol % | Ti d' mol % |
| Comparative Example | 19 | 80.00 | 20.00 | 25.00 | 9.65 |
| Comparative Example | 20 | 70.00 | 30.00 | 25.00 | 9.65 |
| Present invention | 21 | 55.00 | 45.00 | 25.00 | 9.65 |
| Present invention | 22 | 50.00 | 50.00 | 25.00 | 9.65 |
| Present invention | 23 | 45.00 | 55.00 | 25.00 | 9.65 |
| Comparative Example | 24 | 65.00 | 35.00 | 20.00 | 9.65 |
| Comparative Example | 25 | 65.00 | 35.00 | 22.00 | 9.65 |
| Present invention | 26 | 65.00 | 35.00 | 40.00 | 9.65 |
| Comparative Example | 27 | 65.00 | 35.00 | 50.00 | 9.65 |
| Comparative Example | 28 | 65.00 | 35.00 | 60.00 | 9.65 |
| Present invention | 29 | 65.00 | 35.00 | 25.00 | 5.00 |
| Comparative Example | 30 | 65.00 | 35.00 | 25.00 | 20.00 |
| Comparative Example | 31 | 65.00 | 35.00 | 25.00 | 30.00 |
| Prior art | 18 | 70.00 | 30.00 | 2.00 | 5.60 |

TABLE 4

| Content Ratio in Completed Product of Thermistor Element (Modification) | | | | | | | | | | | |
|---|---|---|---|---|---|---|---|---|---|---|---|
| | | Mn + Ni = 100 mol % | | Ratio based on Mn + Ni =100 [mol %] | Ratio based on Mn + Ni = 100 [mol %] | Electrical characteristic evaluation results | | Reliability test A (left standing at 125° C. for 1000 hours) | | Reliability test B (left standing at 150° C. for 1000 hours) | |
| | Lot Nos. | Mn a mol % | Ni b mol % | Fe c mol % | Ti d mol % | ρ25 kΩ cm | B25/50 K | ΔR % | Δ B25/50 % | ΔR % | Δ B25/50 % |
| Comparative Example | 19 | 79.82 | 20.18 | 24.73 | 9.73 | 4723.9 | 5256 | 1.26 | 0.17 | 2.00 | 0.52 |
| Comparative Example | 20 | 69.84 | 30.16 | 24.73 | 9.73 | 185.5 | 4426 | 0.59 | 0.06 | 1.35 | 0.14 |
| Present invention | 21 | 54.87 | 45.13 | 24.73 | 9.73 | 36.1 | 3905 | 0.04 | 0.03 | 0.35 | 0.08 |
| Present invention | 22 | 49.88 | 50.12 | 24.73 | 9.73 | 54.1 | 3929 | 0.07 | 0.03 | 0.36 | 0.06 |
| Present invention | 23 | 44.90 | 55.10 | 24.73 | 9.73 | 78.1 | 3931 | 0.04 | 0.01 | 0.33 | 0.03 |
| Comparative Example | 24 | 64.85 | 35.15 | 19.78 | 9.73 | 32.4 | 3999 | 0.11 | 0.06 | 0.84 | 0.16 |
| Comparative Example | 25 | 64.85 | 35.15 | 21.76 | 9.73 | 36.9 | 4006 | 0.12 | 0.06 | 0.72 | 0.13 |
| Present invention | 26 | 64.85 | 35.15 | 39.57 | 9.73 | 702.3 | 4628 | 0.04 | 0.02 | 0.20 | 0.03 |
| Comparative Example | 27 | 64.85 | 35.15 | 49.46 | 9.73 | 5869.5 | 5201 | 0.12 | 0.15 | 0.56 | 0.25 |
| Comparative Example | 28 | 64.85 | 35.15 | 59.35 | 9.73 | Impossible to measure | Impossible to measure | Impossible to measure | Impossible to measure | Impossible to measure | Impossible to measure |
| Present invention | 29 | 64.85 | 35.15 | 24.73 | 5.04 | 9.5 | 3695 | 0.03 | 0.03 | 0.31 | 0.09 |
| Comparative Example | 30 | 64.85 | 35.15 | 24.73 | 20.17 | 7468.9 | 4230 | Impossible to measure | Impossible to measure | Impossible to measure | Impossible to measure |
| Comparative Example | 31 | 64.85 | 35.15 | 24.73 | 30.25 | 4989.1 | 3959 | 4.63 | 0.88 | 6.13 | 2.08 |

The inventors of the present application calculated a B constant between 25° C. and 50° C. (B25/50) in the same manner as in the above embodiment for each of Lot Nos. 19 to 31.

For each of Lot Nos. 19 to 31, the reliability tests A and B described in the above embodiment were conducted to calculate a resistance change rate ΔR and a B constant change rate ΔB25/50 after each of the reliability tests A and B.

In Table 4, the above calculated value is also described for each Lot No.

As is apparent from Table 4, Lot Nos. 21 to 23, 26 and 29 have electrical characteristics (ρ25 and B25/50) sufficiently practicable as a NTC thermistor element similarly to Lot Nos. 1 to 17. Further, for Lot Nos. 21 to 23, 26 and 29, ΔR is 0.36% or less, and ΔB25/50 is 0.09% or less after the reliability test B is conducted. These values are lower than the values for the conventional NTC thermistor element (i.e. Lot No. 18), and it is apparent that the thermistor elements of Lot Nos. 21 to 23, 26 and 29 have an extremely small change in electrical characteristics even when left standing under a high-temperature environment of 150° C. for 1000 hours. That is, it is apparent that those thermistor elements are excellent in heat resistance.

As described above, when the contents of Mn, Ni, Fe and Ti in the substrate 2 are made to fall within the value range described in (7) and (8), heat resistance of the NTC thermistor element 1 can be improved.

CONCLUSION

From the above embodiment and the above modification, the following conclusion is made: when the molar amounts of Mn, Ni, Fe and Ti in the raw material of NTC thermistor element 1 are made to fall within the value range described in (9) and (10) below, heat resistance of the NTC thermistor element 1 can be improved.

(9) $45.00 \leq a' \leq 65.42$ and $34.58 \leq b' \leq 55.00$.

(10) $25.48 \leq c' \leq 40.00$ and $5.00 \leq d' \leq 10.10$.

For the completed product of the NTC thermistor element 1, when the contents of Mn, Ni, Fe and Ti in the substrate 2 are made to fall within the value range described in (11) and (12), heat resistance of the product can be improved.

(11) $44.90 \leq a \leq 65.27$ and $34.73 \leq b \leq 55.10$.

(12) $24.22 \leq c \leq 39.57$ and $5.04 \leq d \leq 10.18$.

The thermistor elements according to the present invention are excellent in heat resistance, and suitable for not only for household electric appliances and consumer appliances but also for on-vehicle applications in particular.

DESCRIPTION OF REFERENCE SYMBOLS

1 Thermistor element
2 Substrate
3 Internal electrode
4*a*, 4*b* External electrode
5*a*, 5*b* First plated film
6*a*, 6*b* Second plated film

The invention claimed is:

1. A NTC thermistor element comprising:

a substrate composed of a ceramic material containing Mn, Ni, Fe and Ti; and a pair of external electrodes on the substrate, wherein when a molar amount of Mn is a [mol %] and a molar amount of Ni is b [mol %], a and b satisfy a+b=100, $44.90 \leq a \leq 65.27$ and $34.73 \leq b \leq 55.10$, and when a molar amount of Fe is c [mol %] and a molar amount of Ti is d [mol %], c and d satisfy $24.22 \leq c \leq 39.57$ and $5.04 \leq d \leq 10.18$ based on a+b=100.

2. The NTC thermistor element according to claim 1, wherein the substrate has a negative temperature coefficient.

3. The NTC thermistor element according to claim 1, further comprising a plurality of internal electrodes within the substrate, a first set of the plurality of internal electrodes being electrically connected to a first electrode of the pair of external electrodes, and a second set of the plurality of internal electrodes being electrically connected to a second electrode of the pair of external electrodes.

4. The NTC thermistor element according to claim 1, wherein the pair of external electrodes comprise a noble metal.

5. The NTC thermistor element according to claim 1, further comprising first plated films on each of the pair of external electrodes.

6. The NTC thermistor element according to claim 5, wherein the first plated films comprise Ni.

7. The NTC thermistor element according to claim 5, further comprising second plated films on the first plated films.

8. The NTC thermistor element according to claim 7, wherein the second plated films comprise Sn.

9. A method for producing a NTC thermistor element, the method comprising:

preparing a substrate from a ceramic raw material composed of a manganese compound, a nickel compound, an iron compound and a titanium compound; and forming a pair of external electrodes on the substrate, wherein when a molar amount of Mn in the ceramic raw material is a' [mol %] and a molar amount of Ni in the raw material is b' [mol %], a' and b' satisfy $a'+b'=100$, $45.00 \leq a' \leq 65.42$ and $34.58 \leq b' \leq 55.00$, and when a molar amount of Fe in the ceramic raw material is c' [mol %] and a molar amount of Ti in the raw material is d' [mol %], c' and d' satisfy $25.48 \leq c' \leq 40.00$ and $5.00 \leq d' \leq 10.10$ based on $a'+b'=100$.

10. The method for producing a NTC thermistor element according to claim 9, wherein the manganese compound is $Mn_3O_4$, the nickel compound is NiO, the iron compound is $Fe_2O_3$ and the titanium compound is $TiO_2$.

11. The method for producing a NTC thermistor element according to claim 9, further comprising forming a plurality of internal electrodes within the substrate, a first set of the plurality of internal electrodes being electrically connected to a first electrode of the pair of external electrodes, and a second set of the plurality of internal electrodes being electrically connected to a second electrode of the pair of external electrodes.

12. The method for producing a NTC thermistor element according to claim 9, wherein the pair of external electrodes comprise a noble metal.

13. The method for producing a NTC thermistor element according to claim 9, further comprising forming first plated films on each of the pair of external electrodes.

14. The method for producing a NTC thermistor element according to claim 13, wherein the first plated films comprise Ni.

15. The method for producing a NTC thermistor element according to claim 13, further comprising forming second plated films on the first plated films.

16. The method for producing a NTC thermistor element according to claim 15, wherein the second plated films comprise Sn.

* * * * *